US007587160B2

(12) United States Patent
Thomas et al.

(10) Patent No.: US 7,587,160 B2
(45) Date of Patent: Sep. 8, 2009

(54) TONER REPELLING STRIPPER FINGER ASSEMBLY

(75) Inventors: Leigh-Anne Thomas, Bath (GB); John R Washington, Sandy (GB); Martin Callis, Hemel Hempstead (GB); John Poxon, Stevenage (GB); Lloyd Broughton, Welwyn Garden City (GB)

(73) Assignee: Xerox Corporation, Norwalk, CT (US)

( * ) Notice: Subject to any disclaimer, the term of this patent is extended or adjusted under 35 U.S.C. 154(b) by 401 days.

(21) Appl. No.: 11/564,069

(22) Filed: Nov. 28, 2006

(65) Prior Publication Data

US 2008/0124140 A1 May 29, 2008

(51) Int. Cl.
*G03G 15/20* (2006.01)

(52) U.S. Cl. ..... 399/323

(58) Field of Classification Search ..... 399/322, 399/323, 399

See application file for complete search history.

(56) References Cited

U.S. PATENT DOCUMENTS 4,929,983 A 5/1990 Barton et al.
5,053,830 A * 10/1991 Arai ..... 399/323
5,160,130 A 11/1992 Fromm et al.
6,785,503 B2 8/2004 Kuo et al.
7,302,217 B2 * 11/2007 Takiguchi et al. ..... 399/310

FOREIGN PATENT DOCUMENTS

JP 2001-100585 * 4/2001

* cited by examiner

*Primary Examiner*—Sandra L Brase
(74) *Attorney, Agent, or Firm*—Ronald E. Prass, Jr.; Prass LLP

(57) ABSTRACT

A toner repelling stripper finger assembly is provided for stripping toner image carrying copy sheets from an outer surface of a moving heated fusing member. The toner repelling stripper finger assembly includes (a) a finger shaft having a first end for attaching to a baffle, and a second distal end; (c) an electrically conductive tip located at the second distal end of the finger shaft for contacting the outer surface of the moving heated fusing member to strip the toner image carrying copy sheets therefrom; and (d) an electrical biasing source connected to the electrically conductive tip for electrically biasing the electrically conductive tip to a desired electrical polarity, thereby repelling and preventing charged toner particles from being attracted and building up on the stripper finger assembly.

18 Claims, 2 Drawing Sheets

TONER REPELLING STRIPPER FINGER ASSEMBLY

Figure 1:
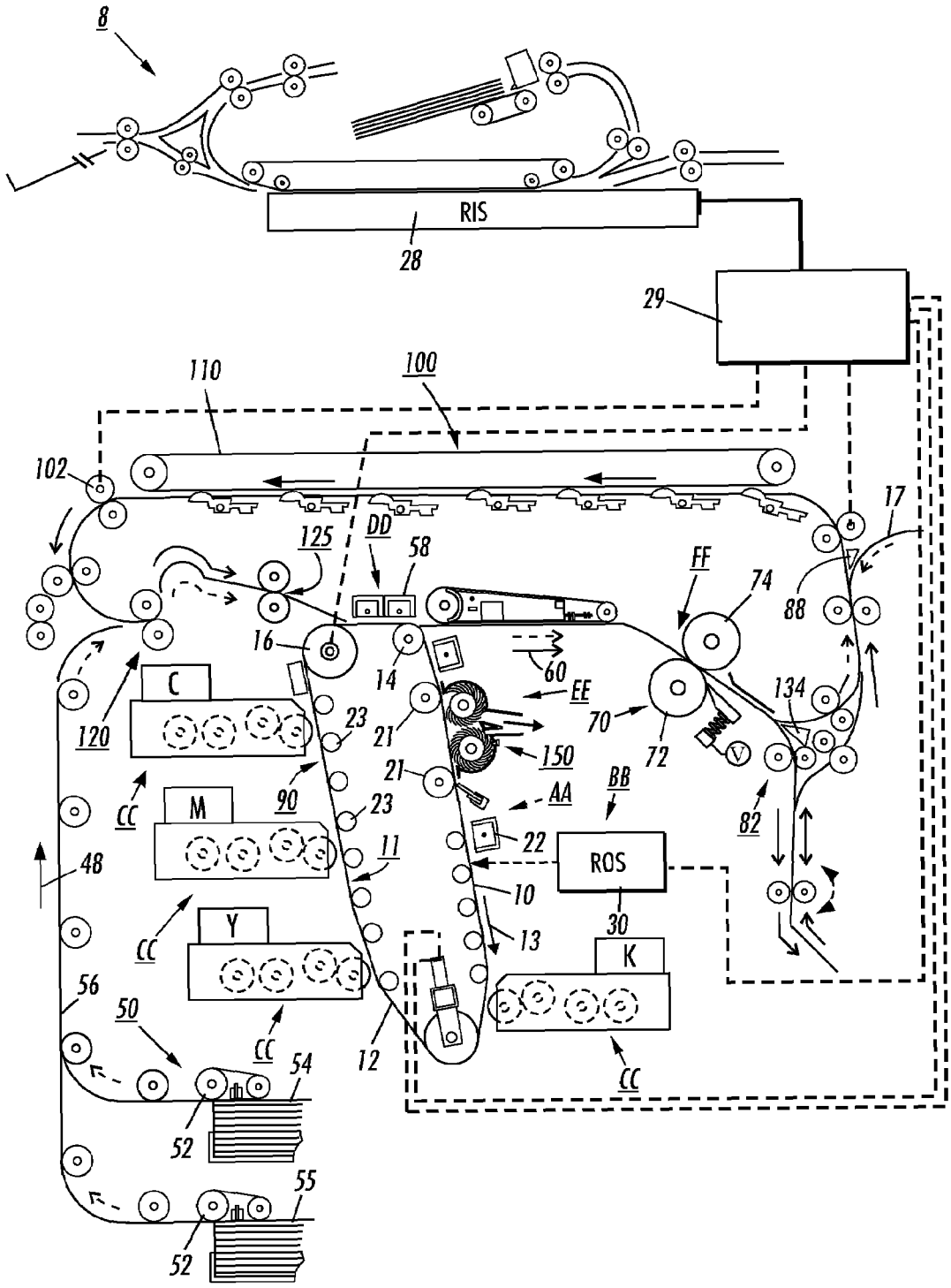

The present invention relates to an electrostatographic reproducing machine and, more particularly, to such a machine including a toner repelling, electrically biased stripper finger assembly.

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as paper, and the surface of the photoreceptor is cleaned and prepared to be used once again for the reproduction of a copy of an original. The paper with the powdered toner thereon in image wise configuration is separated from the photoreceptor and moved through a fuser apparatus to permanently fix or fuse the toner image to the paper.

One approach to fixing, or "fusing," the toner image is applying heat and pressure by passing the copy sheet carrying the unfused toner image between a pair of opposed roller members of a fusing apparatus, at least one of the rollers is internally heated. During this procedure, the biasing level and polarity of the toner material is elevated to a biasing level and polarity at that the toner material coalesces and becomes tacky. This heating causes the toner to flow to some extent into the fibers or pores of the sheet. Thereafter, as the toner material cools, solidification of the toner material causes the toner material to become bonded to the sheet.

After the fusing step, the sheet carrying the fused image is stripped from the fusing member and then fed to a subsequent processing station, such as an inverter, collator, stapler, or booklet maker. Prior art stripper finger assemblies typically involve solid rigid fingers that either slide away from the fuser surface or include expensive articulating assemblies for attempting to achieve similar results. Examples of fusing apparatus including such prior art stripper finger assemblies are disclosed in the following references. U.S. Pat. No. 4,929,983 issued May 29, 1990 and entitled "Stripper mechanism" discloses a stripper for separating a print substrate from a fusing member in an electrostatographic printing machine has a substantially flat, thin, resiliently flexible finger-like member having a raised dimple-like bump adjacent one end of the finger-like member for contacting the print substrate when stripped from the fusing member, the finger-like member being coated on both sides with a smooth low surface energy film.

U.S. Pat. No. 5,160,130 issued Nov. 3, 1992 and entitled "Thin-tip stripper finger for use with a fuser roll in an electrostatographic apparatus" discloses a stripper finger separates a substrate from a fusing member in an electrostatographic reproduction machines. The stripper finger is a member defining an edge in the form of a symmetrical convex arc across the width of the member. The thickness of the member decreases from a chord through the convex arc perpendicular to the axis of symmetry of the arc, to the edge.

U.S. Pat. No. 6,785,503 issued Aug. 31, 2004 and entitled "Stripper fingers and roller assembly for a fuser in an electrostatographic reproduction machines" discloses stripper fingers that remove the print sheet from a fuser roll in a fuser for xerographic printing. The stripper finger having a tip for stripping a lead edge of a sheet from the fuser roll. A roller assembly, positioned adjacent to the stripper finger; for engaging the lead edge of a sheet and lifting the sheet from further contact with the tip after the tip of the stripper finger strips the lead edge of the sheet from the fuser roll. The roller assembly is removably mounted by using a snap-on mounting structure.

Unfortunately, conventional stripper fingers such as those disclosed herein have a tendency tolerate a build up of toner particles. Thus, toner image reproduction machines with such conventional stripper fingers will tend to suffer from contamination on sheets of copies being produced because such contaminated stripper fingers detrimentally cause undesirable image blotches and marks on the sheets of subsequent copies stripped by such contaminated fingers from the fusing apparatus.

In accordance with the present disclosure, there has been provided a toner repelling stripper finger assembly for stripping toner image carrying copy sheets from an outer surface of a moving heated fusing member. The toner repelling stripper finger assembly includes (a) a finger shaft having a first end for attaching to a baffle, and a second distal end; (c) an electrically conductive tip located at the second distal end of the finger shaft for contacting the outer surface of the moving heated fusing member to strip the toner image carrying copy sheets therefrom; and (d) an electrical biasing source connected to the electrically conductive tip for electrically biasing the electrically conductive tip to a desired electrical polarity, thereby repelling and preventing charged toner particles from being attracted and building up on the stripper finger assembly.

Figure 2:
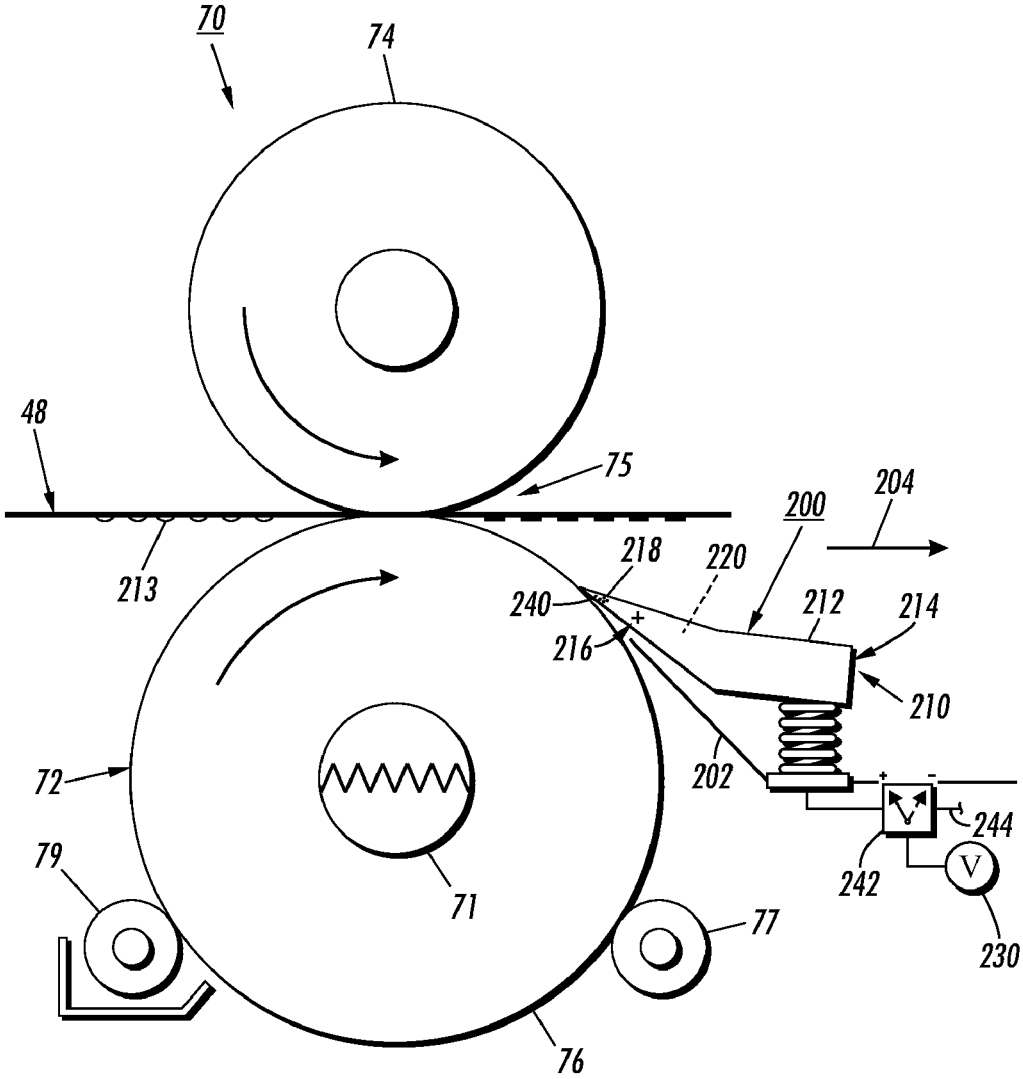

FIG. 1 is a schematic elevational view of an exemplary electrostatographic reproduction machine including a fusing apparatus including the toner repelling stripper finger assembly in accordance with the present disclosure; and FIG. 2 is an enlarged end section schematic of the fusing apparatus of FIG. 1 showing further details of the toner repelling stripper finger assembly in accordance with the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information, as well as selectively control various aspects of such functions, including for example the polarity and level of charge to the toner repelling stripper finger assembly of the present disclosure.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners charged to a desired polarity, in the form of dry particles. At each developer unit the charged toner particles are appropriately attracted electrostatically to the latent image using commonly known electrostatographic imaging techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed. Transfer station DD typically includes a corona-generating device 58 that sprays ions of a suitable polarity onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

Fusing station FF includes the fusing apparatus of the present disclosure that is indicated generally by the reference numeral 70 for fusing and permanently affixing the transferred toner powder image 213 to the copy sheet 48. Preferably, fusing apparatus 70 includes a heated fuser roller 72 having an outer surface 76, and a pressure roller 74 that form a fusing nip 75 through which the sheet 48 is passed with the powder image 213 on the copy sheet 48 contacting fuser roller 72. The pressure roller 74 is loaded against the fuser roller 72 forming the fusing nip 75 for providing the necessary pressure to fix the heated toner powder image 213 to the copy sheet. The fuser roll 72 for example is internally heated by a quartz lamp 71. The fuser roll outer surface 76 may be cleaned by a roll 77, and release agent, stored in a reservoir (not shown), may be pumped to a metering roll 79 for application to the surface as shown, after the sheet is stripped from such surface by the toner repelling stripper finger assembly 200 of the present disclosure (to be described in more detail below).

After that, the sheet 48 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed by a cleaning apparatus 150 at cleaning station EE.

Referring now to FIGS. 1-2, the fusing apparatus 70 includes the toner repelling stripper finger assembly 200 for stripping toner image carrying copy sheets 48 from an outer surface 76 of the moving heated fusing member or fuser roller 72. As illustrated, the toner repelling stripper finger assembly 200 includes (a) at least one baffle 202 forming part of a sheet path 204 downstream of the fusing nip 75; (b) a finger 210 comprising a finger shaft 212 having a first end 214 for attaching to the at least one baffle 202, and a second distal end 216 including an electrically conductive finger tip 218 for contacting the outer surface 76 of the moving heated fusing member or fuser roller 72 to strip the toner image carrying copy sheets 48 therefrom; (c) an electrical biasing source 230 having a desired polarity P, N; and (d) an electrically conductive member 220, such as a spring as shown, that is connected to the tip 218 and to the electrical biasing source 230 for biasing the tip 218 to a desired polarity, and at a desired voltage level, for example, within a range of −300 to −500 volts for negatively charged toner particles within the same range. Although only one finger 210 is illustrated, as is well known, a plural number of such finger 210 would be required and would be arranged spaced apart from one end to the other, longitudinally, of the fuser roller 72.

The finger 210 as a whole may be made of an electrically conductive material, it could be made of a non-conductive material in which case the electrically conductive tip 218 would be formed by coating with a conductive coating 240 such as metallic paint. The biasing source 230 for example comprises a voltage source that as shown is connected, through a control device 242, by an electrically conductive member 220, for example an electrically conductive spring. The control device 242 is connected by means 244 to the controller 29 and is capable of being selected to apply positive P or negative N polarity charge to the finger tip 218, depending on which of the positive and negative polarity is the same as the polarity of the charged toner particles 213 forming the images being fused and stripped.

Although only one finger assembly is illustrated, the toner repelling stripper finger assembly 200 will include a plural number of the finger 210 each with a shaft 212 and a corresponding plural number of the electrically conductive tip 218. Accordingly, each conductive tip 218 will be connected as described to an electrically biasing source 230.

As can be seen, there has been provided a toner repelling stripper finger assembly for stripping toner image carrying copy sheets from an outer surface of a moving heated fusing member. The toner repelling stripper finger assembly includes (a) a finger shaft having a first end for attaching to a baffle, and a second distal end; (c) an electrically conductive tip located at the second distal end of the finger shaft for contacting the outer surface of the moving heated fusing member to strip the toner image carrying copy sheets therefrom; and (d) an electrical biasing source connected to the electrically conductive tip for electrically biasing the electrically conductive tip to a desired electrical polarity, thereby repelling and preventing charged toner particles from being attracted and building up on the stripper finger assembly.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A toner repelling stripper finger assembly for stripping toner image carrying copy sheets from an outer surface of a moving heated fusing member, the toner repelling stripper finger assembly comprising:

(a) a finger shaft having a first end for attaching to a baffle, and a second distal end;

(b) an electrically conductive tip located at said second distal end of said finger shaft for contacting the outer surface of said moving heated fusing member to strip said toner image carrying copy sheets therefrom;

(c) an electrical biasing source connected to said electrically conductive tip for electrically biasing said electrically conductive tip to a desired electrically polarity, thereby repelling and preventing charged toner particles from being attracted and building up on the stripper finger assembly; and (d) a control device for selectively controlling polarity electrical bias on said electrically conductive tip.

2. The toner repelling stripper finger assembly of claim 1, including a plural number of said finger shaft and a corresponding plural number of said electrically conductive tip.

3. The toner repelling stripper finger assembly of claim 1, wherein said electrically conductive finger tip comprises an electrical coating on a nonconductive material.

4. The toner repelling stripper finger assembly of claim 3, wherein said electrically conductive coating is a metallic paint.

5. The toner repelling stripper finger assembly of claim 1, wherein said biasing source comprises a voltage source.

6. The toner repelling stripper finger assembly of claim 1, wherein said biasing source has an electrical polarity that is the same as a polarity of charge on the charged toner particles forming toner images being fused.

7. The toner repelling stripper finger assembly of claim 1, including an electrically conductive spring member connecting said electrical biasing source to said electrically conductive tip.

8. A toner fusing apparatus comprising:

(a) a movable pressure fusing member having a first outer surface;

(b) a movable heated fusing member having a second outer surface forming a fusing nip with said first outer surface of said movable pressure fusing member for receiving, heating and fusing toner image carrying copy sheets; and (c) a toner repelling stripper finger assembly for stripping toner image carrying copy sheets from an outer surface of a moving heated fusing member, the toner repelling stripper finger assembly comprising:

(i) a finger shaft having a first end for attaching to a baffle, and a second distal end;

(ii) an electrically conductive tip located at said second distal end of said finger shaft for contacting the outer surface of said moving heated fusing member to strip said toner image carrying copy sheets therefrom;

(iii) an electrical biasing source connected to said electrically conductive tip for electrically biasing said electrically conductive tip to a desired electrically polarity, thereby repelling and preventing charged toner particles from being attracted and building up on the stripper finger assembly; and (iv) a control device for selectively controlling polarity electrical bias on said electrically conductive tip.

9. The toner fusing apparatus of claim 8, including a plural number of said finger shaft and a corresponding plural number of said electrically conductive tip.

10. The toner fusing apparatus of claim 8, wherein said electrically conductive finger tip comprises an electrical coating on a non-conductive material.

11. The toner fusing apparatus of claim 8, wherein said biasing source has an electrical polarity that is the same as a polarity of charge on the charged toner particles forming toner images being fused.

12. The toner fusing apparatus of claim 8, including an electrically conductive spring member connecting said electrical biasing source to said electrically conductive tip.

13. An electrostatographic reproduction machine comprising:

(a) a moveable imaging member including an imaging surface;

(b) latent imaging means for forming a latent electrostatic toner image on said imaging surface of said moveable imaging member;

(c) a development apparatus mounted adjacent a path of movement of said moveable imaging member for developing said latent electrostatic image on said imaging surface into a toner image;

(d) a transfer station for transferring said toner image from said imaging surface onto a toner image carrying sheet; and (e) a fusing apparatus including a toner repelling stripper finger assembly for stripping toner image carrying copy sheets from an outer surface of a moving heated fusing member of the fusing apparatus, the toner repelling stripper finger assembly comprising:

(i) a finger shaft having a first end for attaching to a baffle, and a second distal end;

(ii) an electrically conductive tip located at said second distal end of said finger shaft for contacting the outer surface of said moving heated fusing member to strip said toner image carrying copy sheets therefrom;

(iii) an electrical biasing source connected to said electrically conductive tip for electrically biasing said electrically conductive tip to a desired electrically polarity, thereby repelling and preventing charged toner particles from being attracted and building up on the stripper finger assembly; and (iv) a control device for selectively controlling polarity electrical bias on said electrically conductive tip.

14. The electrostatographic reproduction machine of claim 13, including a plural number of said finger shaft and a corresponding plural number of said electrically conductive tip.

15. The electrostatographic reproduction machine of claim 13, wherein said electrically conductive finger tip comprises an electrical coating on a nonconductive material.

16. The toner repelling stripper finger assembly of claim 15, wherein said electrically conductive coating is a metallic paint.

17. The electrostatographic reproduction machine of claim 13, wherein said biasing source has an electrical polarity that is the same as a polarity of charge on the charged toner particles forming toner images being fused.

18. The electrostatographic reproduction machine of claim 13, including an electrically conductive spring member connecting said electrical biasing source to said electrically conductive tip.

* * * * *